US005621917A

United States Patent [19]

Howsden

[11] Patent Number: 5,621,917

[45] Date of Patent: Apr. 22, 1997

[54] INFANT CARE GARMENT

[76] Inventor: Sandra R. Howsden, 3258 E. Ridge Pl., Twin Falls, Id. 83301

[21] Appl. No.: 522,584

[22] Filed: Sep. 1, 1995

[51] Int. Cl.[6] ..... A41B 9/00

[52] U.S. Cl. ..... 2/111; 2/114; 2/914

[58] Field of Search ..... 2/111, 114, 69.5, 2/70, 75

[56] References Cited

U.S. PATENT DOCUMENTS

| | | | |
|---|---|---|---|
| 459,106 | 9/1891 | Fifield | 2/70 X |
| 906,551 | 12/1908 | Newman | 2/114 X |
| 2,613,359 | 10/1952 | Boyce | 2/75 X |
| 4,570,268 | 2/1986 | Freeman | 2/114 |
| 4,612,673 | 9/1986 | Underhill | 2/114 |
| 4,688,270 | 8/1987 | Denicola et al. | 2/69.5 X |
| 4,718,124 | 1/1988 | Sawicki et al. | 2/114 |
| 4,901,371 | 2/1990 | Christians | 2/69.5 |
| 5,062,159 | 11/1991 | Jakub | 2/70 X |

*Primary Examiner*—C. D. Crowder
*Assistant Examiner*—Shirra L. Jenkins
*Attorney, Agent, or Firm*—Thorpe North & Western, L.L.P.

[57] ABSTRACT

A garment formed essentially as a sack, the infant's feet occupying a common compartment, the garment having closures located along the top or shoulder portions of the garment and down the front of the garment, the closures comprising a series of intermittently spaced detachably fastenable closure means. The garment is further formed so as to have an aperture for the neck and apertures for the arms and/or hands. The garment may be formed by sewing to a back panel, right and left front panels along the outside edges corresponding to the underarms, the sides and foot of the garment. Alternatively, the garment may be formed by knitting or weaving a sack having an essentially T-shaped configuration. In the preferred embodiment, the series of intermittently spaced detachably fastenable closure means comprise hook and loop closure means.

5 Claims, 4 Drawing Sheets

INFANT CARE GARMENT

BACKGROUND OF THE INVENTION

1. Technical Field

This invention relates generally to infant clothing, and more particularly to clothing designed for use in neonatal intensive care units and for premature infants.

2. Background

Clothing for infants has always been a popular business. Parents, grandparents and other relatives have always reveled in purchasing the perfect outfit for the newborn. Although a substantial percentage of children are born prematurely and/or requiring immediate or intensive care, the availability of clothing which is appropriate either for the premature infant or the infant requiring such special care is limited. Often times, particularly in intensive care situations, the infant is clothed simply in a diaper so that the variety of medical instrumentation and treatment devices can be easily observed, monitored and maintained. Nevertheless, it has been established that with neonatal intensive care unit children, especially those who must remain within the intensive care setting for a lengthened period of time, that clothing a child in something other than simply a diaper benefits the parent-child relationship and the child care giver relationship.

Nevertheless, clothing which is typically available for neonatal intensive care use and premature infant use is typically nothing more than clothing which is typically produced for the infant. Using this clothing for the intensive care infant and the premature infant poses a number of shortcomings. First, and most obviously, clothing which is manufactured or produced for a full-term infant is typically larger than what is needed for the neonatal intensive care or premature infant. Premature infants are often born weighing below 1,000 grams at birth. Secondly, clothing for the neonatal intensive infant must be configured so that it provides to the care giver access to the variety of electrical leads, hoses, catheters and tubes which are necessarily present in the intensive care environment. Clothing for the full-term infant rarely provides this type of access. Finally, clothing for the neonatal intensive care infant and the premature infant should provide easy access to any and all parts of the infant's anatomy, so that caring for the child can be made as easy as possible.

DISCLOSURE OF THE INVENTION

These objectives are accomplished by a garment formed essentially as a sack, opening along the top or shoulder and neck portion of the garment, having an aperture for the neck and apertures for the arms and/or hands. The garment is further formed so as to have an opening down the front of the garment with both of the infant's feet occupying a common compartment. The garment may be formed by sewing to a back panel, right and left front panels along the outside edges corresponding to the underarms, the sides and foot of the garment. Alternatively, the garment may be formed by knitting or weaving a sack having an essentially T-shaped configuration. In either case, those portions of the garment which correspond to the top of the arms or shoulders and the front closure portion of the garment are enclosed by means of a series of intermittently spaced detachably fastenable closure means, which in the preferred embodiment comprise hook and loop closure means, such that between each two corresponding such closure means, an opening exists to accommodate the variety of tubes, hoses and wires which are used in treating and monitoring the prenatal and Neonatal Intensive Care Unit infants.

An additional advantage is realized by this arrangement, namely the child may be easily accessed for treatment including changing of diapers simply by detaching the series of closure means allowing the entire left and right front panels to be pulled away from the child while the back panel remains underneath the child.

BEST MODE FOR CARRYING OUT INVENTION

Figure 1:
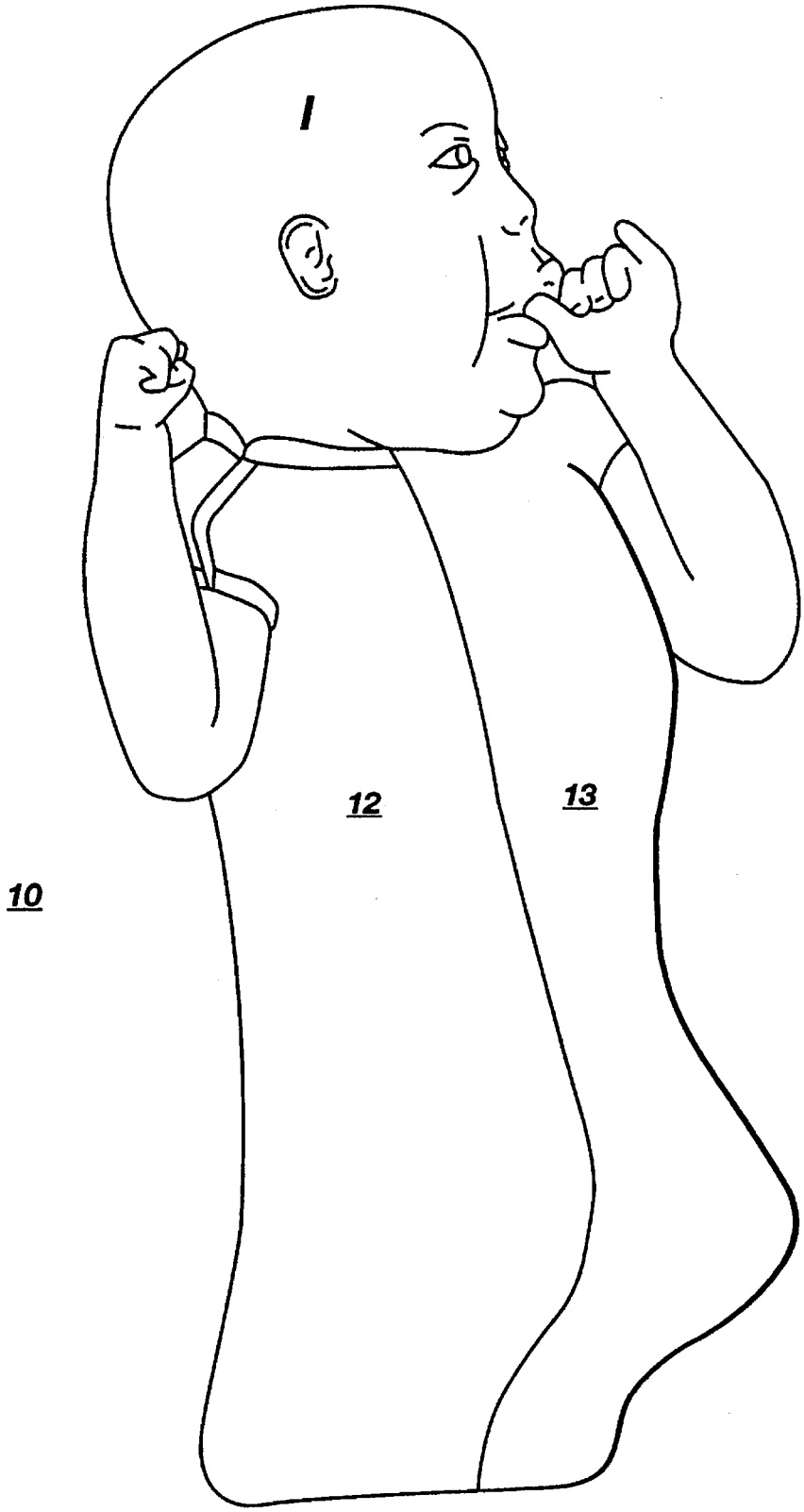
FIG. 1 is a perspective view of an infant clothed in the Premature Infant Care garment.
Figure 2:
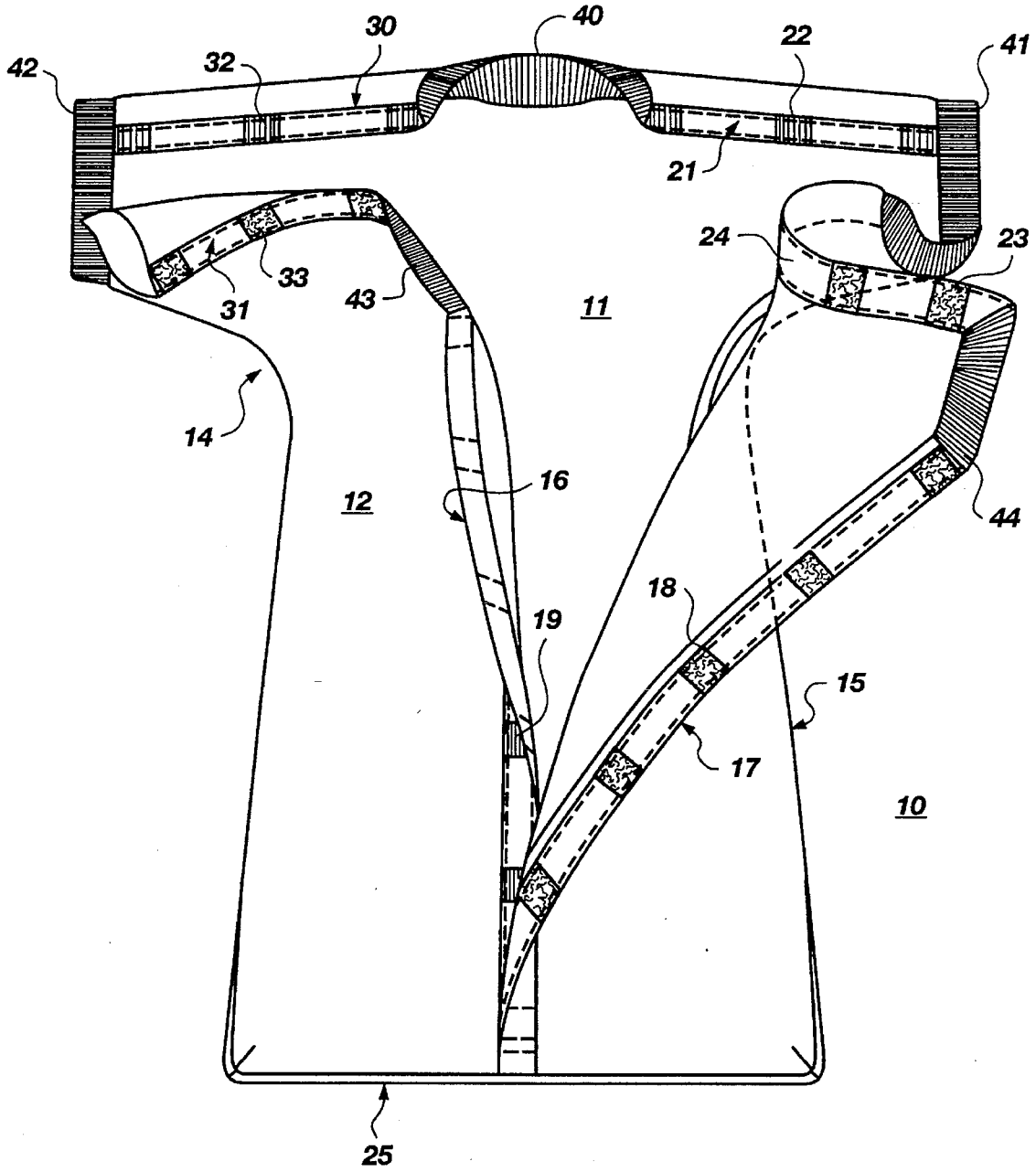
FIG. 2 is a front side view of the Premature Infant Care garment showing the open front panel feature.

Referring now to FIGS. 1 through 4, the preferred embodiment of a premature infant care garment 10 is shown. An L-shaped right front panel 12 is sewn along its right, outside edge to a right, outside edge of a T-shaped back panel 11 so as to form a seam 14. Similarly, an L-shaped left front panel 13 is sewn along its left, outside edge to a left, outside edge of the back panel 11 to form a seam 15. The right front panel 12 and the left front panel 13 are also sew to the back panel along their respective bottom edges to form a seam 25 along a foot portion of the garment.

Figure 3:
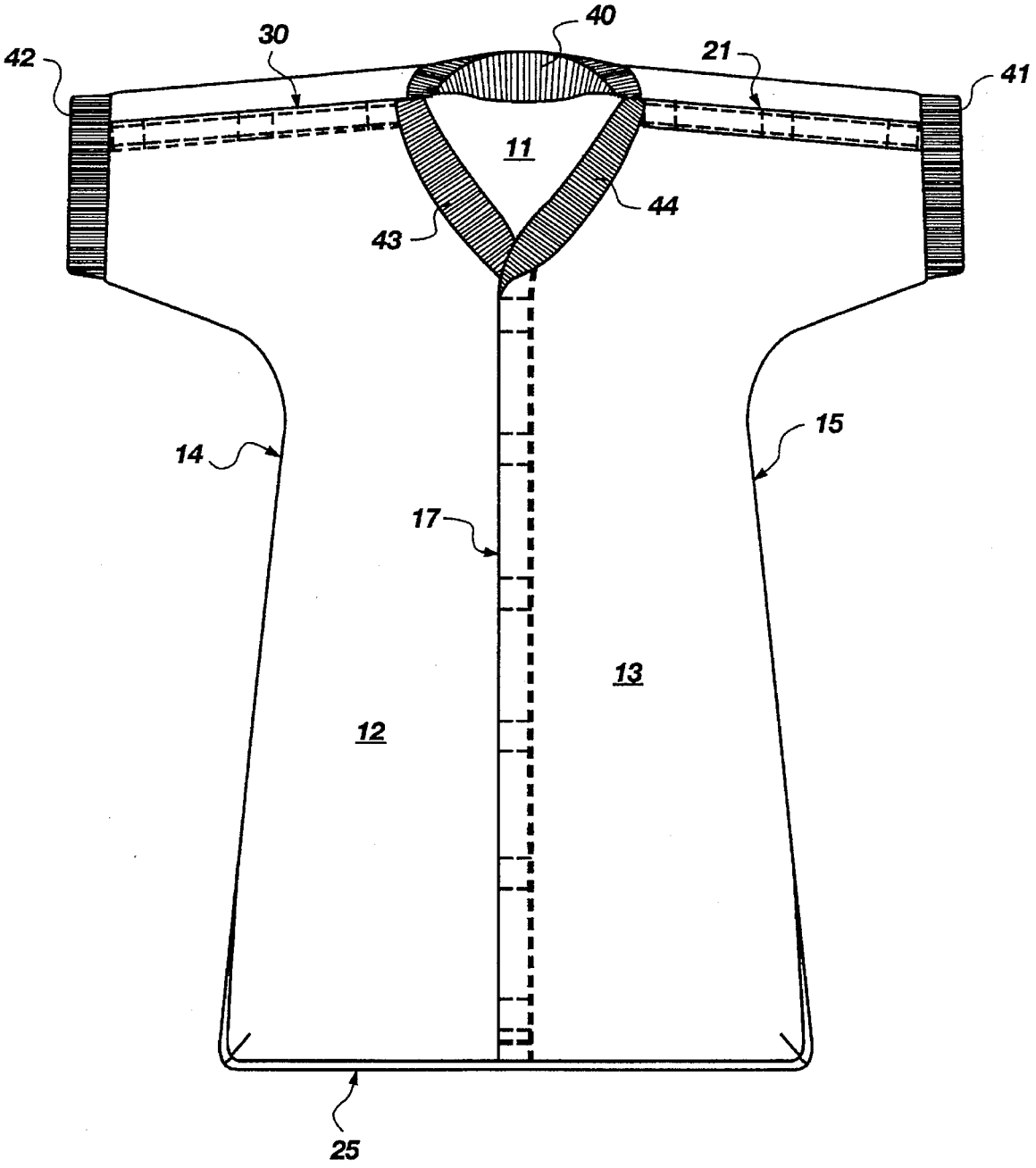
FIG. 3 is a front side view of the Premature Infant Care garment showing the front panel closed.
Figure 4:
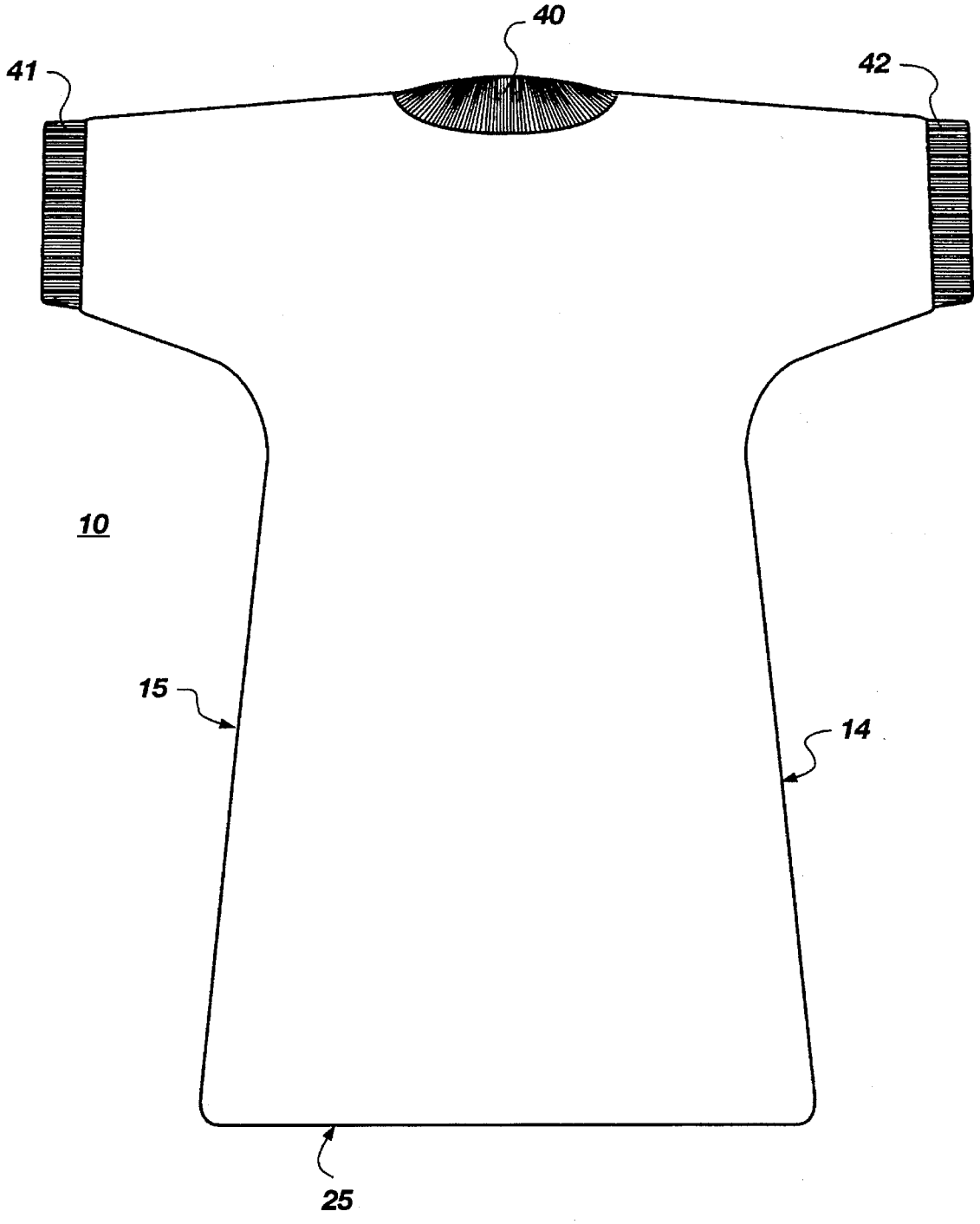
FIG. 4 is a backside view of the Premature Infant Care garment.

The right front panel 12 and the left front panel 13 also each have an inner edge, 16 and 17 respectively, which can be brought together to close the garment along a central portion thereof. The inner edge 16 of the right front portion 12 and the inner edge 17 of the left front portion may be held together by a hook and loop fastener 18 and 19 such as VELCRO. As shown in FIG. 3, only the inner edges of the right front panel and the left front panel overlap when the garment is closed, and the only point of overlap when they are laid open is adjacent the seam.

Similarly, the top edge of the back panel 11 is releasably attachable to the top edges of the right front panel 12 and the left front panel 13. The right front panel 12 is attachable to the right side of the top edge area 30 by the hook and loop fasteners 32 and 33. Likewise, the left front panel 13 is attached to the top edge area 21 by hook and loop fasteners 22 and 23. Additionally, a right arm cuff 42, a left arm cuff 43, and a central, collar cuff 40 are also provided.

In use, the releasably attachment between the back panel 11, the right front panel 12 and the left front panel 13, in addition to the releasable attachment between the edges 16 and 17 of the front panels, enables the premature infant care garment to lay completely open by detaching the hook and look fasteners 18, 19, 22, 23, 32 and 33 and laying open the right and left front panels. Once an infant has been placed on the back panel 11, the garment may be closed by connecting hook and loop fasteners 18 and 19 to cover the infants torso, connecting hook and loop fasteners 22 and 23 to enclose the left shoulder and arm of the infant, and connecting hook and loop fasteners 32 and 33 to enclose the right shoulder and arm of the infant.

Thus there is disclosed a novel premature infant care garment. Those skilled in the art will recognize numerous modifications which can be made without departing from the scope or spirit of the invention. The appended claims are intended to cover such modifications.

I claim:

1. A garment for clothing a neonatal intensive care or premature infant comprising:

a back panel having a generally T-shaped configuration, the back panel having a top edge, a bottom edge, a left outside edge and a right outside edge;

a left front panel having a generally L-shaped configuration, the left front panel having a top edge, an inside edge, an outside edge and a bottom edge, (I) the outside edge of the left front panel being permanently affixed to the left outside edge of the back panel; (ii) the bottom edge of the left front panel being permanently affixed to the bottom edge of the back panel, (iii) and the top edge of the left front panel having hook and loop attachment means disposed therealong for releasable attachment of the top edge of the left front panel to the top edge of the back panel;

a right front panel having a generally L-shaped configuration, the right front panel having a top edge, an inside edge, an outside edge and a bottom edge, (I) the outside edge of the right front panel being permanently affixed to the right outside edge of the back panel (ii) the bottom edge of the right front panel being permanently affixed to the bottom edge of the back panel, (iii) the top edge having hook and loop attachment means for releasably attaching the right front panel to the top edge of the back panel, and (iv) the inside edge of the right front panel being releasably attachable to the inside edge of the left front panel; and wherein the left front panel and right front panel may be laid open when the top edges and inner edges of the panels are unattached.

2. The garment of claim 1, wherein only the inner edges of the right front panel and the left front panel overlap when the right front panel and left front panel are attached to one another.

3. The garment of claim 1, wherein the right front panel and the left front panel only overlap adjacent the bottom edge when the right front panel and the left front panel overlap.

4. A garment for holding infants, the garment comprising:

a back panel having a top edge, a bottom edge, and right and left outside edges disposed therebetween;

a right front panel having a top edge, an outside edge, an inner edge and a bottom edge, the outside edge being sewn to the right outside edge of the back panel, the bottom edge being sewn to the bottom edge of the back panel, and the top edge being releasably attachable to the top edge of the back panel; and a left front panel having a top edge, a bottom edge, an inner edge and an outside edge, the outside edge being sewn to the left outside edge of the back panel, the bottom edge being sewn to the bottom edge of the back panel, and the top edge being releasably attachable to the top edge of the back panel, the inner edge extending so as to overlap only the inner edge of the right front panel so that the right front panel and the left front panel can be laid completely open when not attached to one another.

5. The garment of claim 4, wherein the front panels are attached to the back panel so as to overlap one another only adjacent the bottom edge when the panel are laid open.

* * * * *